US005345221A

United States Patent [19]

Pons et al.

[11] Patent Number: 5,345,221

[45] Date of Patent: Sep. 6, 1994

[54] ARM ALARM SYSTEM

[75] Inventors: John M. Pons, 2404 Cochran Rd., Panama City Beach, Fla. 32408; John J. O'Farrell, Tallahassee, Fla.

[73] Assignee: John Michael Pons, Panama City, Fla.

[21] Appl. No.: 892,340

[22] Filed: Jun. 2, 1992

[51] Int. Cl.[5] ..... G08B 13/14

[52] U.S. Cl. ..... 340/571; 340/574

[58] Field of Search ..... 340/571, 574, 568, 384 E, 340/691, 539, 384.4; 335/205-207

[56] References Cited

U.S. PATENT DOCUMENTS

| | | | |
|---|---|---|---|
| 2,927,311 | 3/1960 | Donaldson | 340/571 |
| 3,851,326 | 11/1974 | Costa | 340/571 |
| 3,988,724 | 10/1976 | Anderson | 340/539 |
| 4,090,183 | 5/1978 | Miller | 340/571 |
| 4,155,079 | 5/1979 | Chiu et al. | 340/571 |
| 4,591,836 | 5/1986 | Feigenblatt, Jr. et al. | 340/574 |
| 4,633,232 | 12/1986 | Nelson et al. | 340/574 X |
| 4,652,865 | 3/1987 | Maharshak | 340/568 |
| 4,719,454 | 1/1988 | Hopkins et al. | 340/574 |
| 4,843,371 | 6/1989 | Kuei et al. | 340/571 X |
| 4,888,580 | 12/1989 | Distel | 340/573 |
| 4,908,607 | 3/1990 | Yannotti et al. | 340/571 |
| 4,927,382 | 5/1990 | Huber | 439/490 |

*Primary Examiner*—Thomas Mullen
*Attorney, Agent, or Firm*—Franklin J. Cona

[57] ABSTRACT

An alarm system for protecting a person and a valuable item from a thief is disclosed. The system comprises a personal module and an item module, each module being identical in size and shape and detail of construction. The modules are adapted to work in a paired, opposed relationship with each other. Each module has a plurality of flat multipole magnetic couplers recessed on an exterior face thereof. Each module has an electrical circuit contained within the casing having a siren transducer and a replaceable DC power source and an alarm switch therebetween. The alarm switch is adapted to close the circuit between the siren transducer and the DC power source when the modules are separated. Further, each module has a reed switch coupled to a magnetic switch in the casing inside the opposed module for deactivating the siren transducer and the replaceable DC power source upon the mating of the modules. The first module, the personal module, is attached to the person by a lanyard. The second module, the valuable item module, is attached to the valuable item with a leash. Each module has a jack switch in a normally closed position to maintain the alarm circuit in a armed state when a switch pin is removed from the jack switch. When the switch pin is inserted in the jack switch, an override condition occurs in the electric circuit and the module is disarmed, regardless of the mating or separation relationship of the modules.

14 Claims, 3 Drawing Sheets

ARM ALARM SYSTEM

BACKGROUND OF THE INVENTION

1. Field of the Invention

The present invention relates to a personal security system. More particularly, the invention relates to a personal security system having two modules. One module is worn by a person and the second module is attached to a valuable item.

2. Description of the Background Art

Many personal security devices have been invented over the years for protecting people and valuable items. Throughout the United States steps are being taken to improve personal security devices. The primary advantage of the personal security device is that it discourages thieves from harming people and from stealing their property.

The invention described herein is a personal security system to protect a person and a valuable item that is normally worn or held by the person in daily life. For example, a person walking a pet or a person with a purse or a person with a briefcase would have use for the personal security system as described herein. This invention has no moving parts, is powered by a low cost, replaceable nine volt DC battery and achieves its purpose with a minimum of training on the part of the person using the system. Further, the invention has override features to allow for replacement of the nine volt battery or for the person to decouple the modules when reattaching the item module to a second valuable item.

The modules are fabricated from an inexpensive nonmagnetic plastic material such as a polycarbonate resin. The electrical components are all readily available off-the-shelf items. The modules can be individually armed to sound an alarm in the vicinity of the person and/or in the vicinity of the valuable item. The modules are coupled through the use of low cost conventional hook and loop fabric fasteners or preferably, flat multipole magnets.

Many personal security systems have been developed in the past to protect people and valuable items.

For example, U.S. Pat. No. 4,908,607 issued to Yannotti, et. al. discloses an anti-pick-pocket device which comprises an alarm when activated upon the uncoupling of a plug.

U.S. Pat. No. 3,851,326 issued to Costa discloses a purse alarm which is activated upon the uncoupling of a plug.

U.S. Pat. No. 4,927,382 issued to Huber discloses an electrical function group with a plug-type connector. An alarm is activated upon the uncoupling of the plug.

U.S. Pat. No. 4,888,580 issued to Distel discloses a device with an alarm buzzer wired to a battery with a magnetic switch means therebetween.

U.S. Pat. No. 2,927,311 issued to Donaldson discloses a portable container with an alarm device, the alarm device becoming active upon uncoupling of a thong.

U.S. Pat. No. 4,115,079 issued to Chiu, et. al. discloses a theftproof suitcase which activates an alarm upon removal of the case from the user's hand.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of the invention to provide a personal security system that is useable by a person with a minimum amount of training.

It is a further object of the invention to provide a personal security system with an audio output sufficient to alert passersby and law enforcement personnel when a robbery or an attack takes place.

A still further object of the invention is to provide a personal security system that will give an audible alarm in the vicinity of the person and/or in the vicinity of the item that is being protected.

It is a still further objective of the invention to provide a personal security system that will sound an alarm in the vicinity of the valuable item after a robbery has taken place that is not easily turned off by the thief.

Although there have been many inventions related to personal security systems, none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention comprises a personal security system having two identical modules that protect a person and a valuable object like a purse, a pet, a handbag, a briefcase or the like. The invention sounds an attention getting audible alarm in the vicinity of the wearer and also sounds a second attention getting audible alarm in the vicinity of the valuable object when a thief snatches the purse or the pet or the briefcase from the person.

More particularly, the invention comprises two identical modules in a coupled, paired, opposed relationship. The modules can be coupled together with conventional hook and loop fabric fasteners or preferably flat coupling magnets. Each flat magnet is housed in a recess on an exterior face of each module. Each module houses a replaceable direct current battery, a siren and an alarm switch. The module casing is made from a nonmagnetic plastic material. The battery and siren in each module form an electrical circuit that is activated and deactivated by a reed alarm switch. The reed alarm switch is in a normally closed position when the modules are separated from each other. The reed alarm switch is in an open position when the modules are mated to each other. The reed alarm switch closes and activates the circuit when the modules are pulled apart as in a robbery or the like. Each alarm switch is in magnetic communication with a switch magnet located in the opposed module when the modules are in a mated relationship.

Each module has a jack switch that overrides the reed alarm switch closure when the modules are separated. A switch pin is inserted in an aperture in the module and contacts and deflects a flat bar element of the jack switch, thereby maintaining an open circuit condition, regardless of the mated or pulled-apart relationship of the modules. This is useful when changing purses or when the person wishes to attach a module to another valuable item, or further, when the person wishes to change the nine volt DC battery in the module.

The system is armed by first coupling the modules in a face-to-face relationship. The flat magnets in each face are housed in a recess therein and are designed to align the horizontal and vertical edges of each module in a congruent relationship. Then, the person attaches a lanyard to a lug on the first module and to herself. In a similar manner, a leash is attached to a lug on the second module and to the valuable item, such as a pet, a purse, or a briefcase. Then, the system is put in a "armed" status by removing the switch pin from the jack switch in each module. If desired, the person could alarm only one module by removing one switch pin from one jack switch and leaving the switch pin in the override position in the other module. For example, one might choose to arm only the module attached to the person, or one might choose to arm the module attached to the valuable item. In either case, each switch pin has a small chain attached to an end to facilitate insertion and removal when in use and operation.

When the modules are coupled face-to-face, and each switch pin is still in contact with their respective jack switch, the electrical circuit in each module has two open circuit conditions. The first open circuit condition, the override condition, is caused by the jack switch, which can only be closed by the removal of the switch pin from the module. The second open circuit condition, the armed condition, is maintained by the reed switch being in an open circuit condition by being in magnetic proximity to a switch magnet in the opposed module. As long as the modules are in a coupled relationship, each switch magnet will maintain the opposed reed switch in an open circuit condition.

The system is armed by removing the switch pin from each module. Then, when the armed modules are separated due to the thief pulling the valuable item from the person, the electric circuit in each module is closed when the switch magnet is removed from magnetic proximity to the reed switch in the opposed module.

The siren in each module produces an audible alarm of about 110 decibels, as measured within an arms-length or approximately 30 centimeters. The audible alarm alerts passersby and law enforcement personnel that a robbery is taking place. The siren in the module worn by the person can be shut off by merely reinserting the switch pin in the jack switch. However, the siren in the module attached to the valuable item will continue to sound the audible alarm until the battery is completely drained. The audible alarm can be modulated to produce a variation in the output sound to attract additional attention. The modulation can be achieved either by frequency modulation or amplitude modulation.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
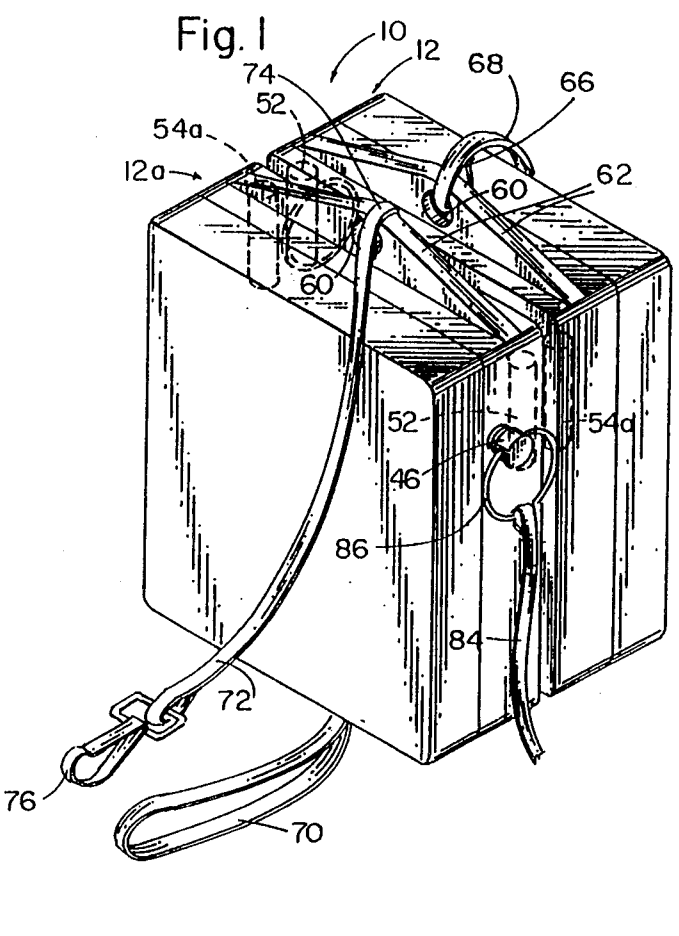
FIG. 1 is a perspective drawing of the invention showing the module in the coupled, paired, opposed relationship.
Figure 5:
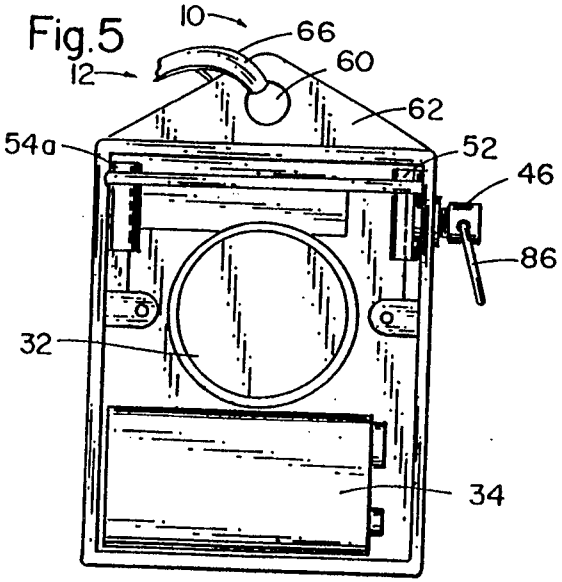
FIG. 5 is a sectional elevation view taken along the lines 4—4 of FIG. 4.
Figure 4:
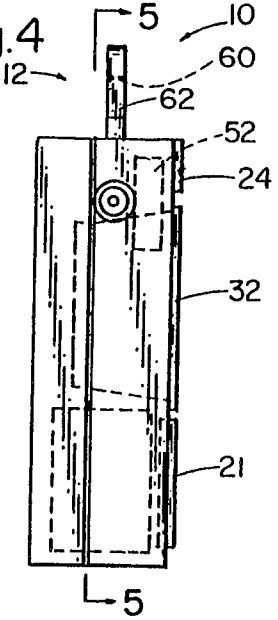
FIG. 4 is a left side elevation view of one module.

Referring to FIG. 1, the invention comprises a personal alarm system 10 having a plurality of identical modules 12, 12*a* in a paired, opposed relationship. Each module 12 has an outer casing 14 molded from a plastic, non-magnetic material. Each module 12 further has an exterior face 16 adapted for mating to the opposite exterior face 16*a* in a coupled relationship that can be decoupled with a modest pulling-apart effort. Each exterior face 16 has an lower section 18 with a plurality of recesses 20,20*a*, each recess 20 being adapted to receive a coupler 21. Also, each exterior face 16 has a upper section 22 with a plurality of recesses 23,23*a*, each recess 23 being adapted to receive a second coupler 24. Each recess 20,23 houses the coupler 21,24 respectively, and each coupler 21,24 interacts with the opposed coupler 21a,24a in the paired opposed exterior face 16a. The coupling relationship can be achieved with conventional hook and loop fabric fasteners.

Figure 2:
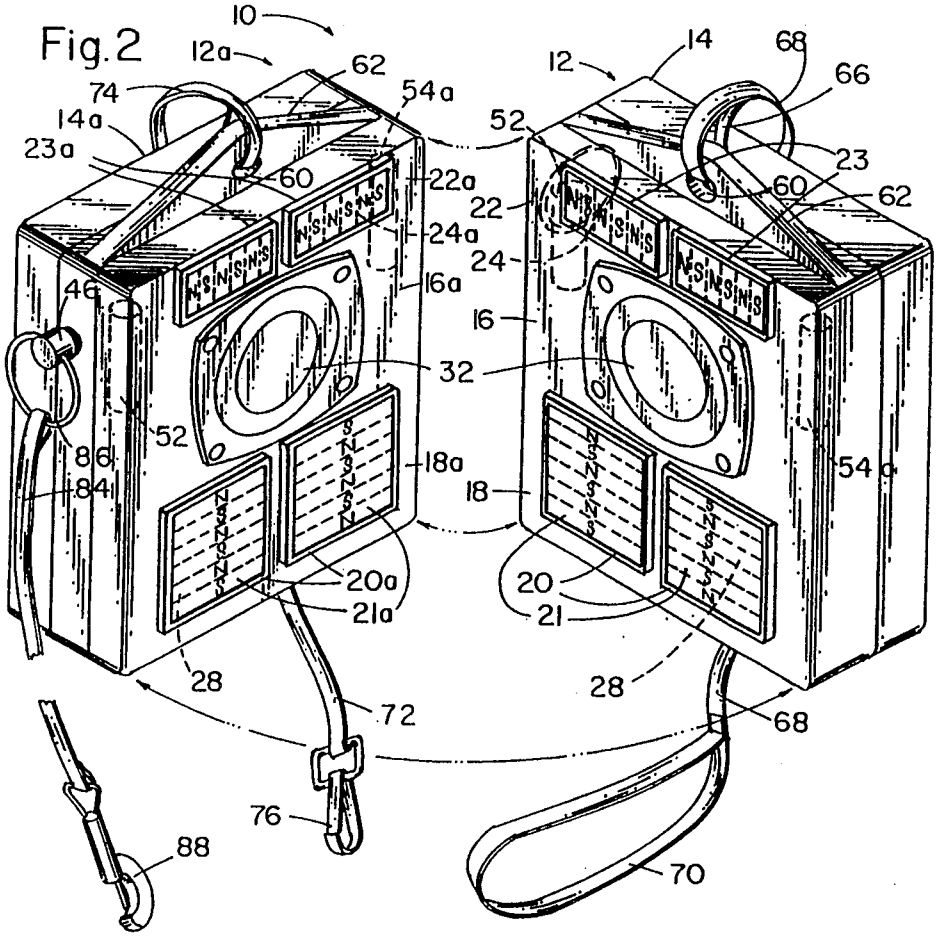
FIG. 2 is a perspective of the invention showing the modules in an open, separated, relationship and showing the exterior face of each module.

In the preferred embodiment, the coupling is achieved with a plurality of multipole magnets 28, 28a, 28b, 28c, 28d, 28e, 28f, 28g. Each of the multipole magnets 28 is housed in one of the recesses 20 and 23 on the exterior face 16 of each module 12. Each multipole magnet 28 is enclosed within a thermoplastic material and forms a homogeneous flat rectangular shape. Further, each multipole magnet 28 has a plurality of alternating north and south poles for urging congruent magnetic coupling with respect to the opposed flat multipole magnet 28 in the opposed recess 20 and 23 respectively, on the opposite interior face 16a as best seen in FIG. 2.

Further, each module 12 has an electrical circuit 30 having a siren transducer 32, a direct current power source 34 and an alarm switch 36 therebetween within the casing 14 to activate the electrical circuit 30 when the modules 12 and 12a are pulled apart, as in a robbery or the like.

Each module 12 further has a aperture 44 adapted to receive an elongated switch pin 46 in the outer portion thereof for overriding the closure of the electrical circuit 30 by the alarm switch 36 therein upon the separation of the modules 12 and 12a. Each elongated switch pin 46 contacts and deflects a flat bar element 48 of a jack switch 50 adjacent to an interior end 51 of the recessed aperture 44 in each module 12 for disarming the electrical circuit 30 in each module 12, regardless of the mating or the separation of the modules 12 and 12a.

The alarm switch 36 in the module 12 has a reed switch 52 in magnetic communication with a switch magnet 54a in the opposite module 12a. Each reed switch 52 and each switch magnet 54a are recessed behind the outer casing 14 of their respective module 12, 12a. The paired, opposed switch magnet 54a and reed switch 52 urge the electrical circuit 30 to an inactive, open status when the modules 12, 12a are in a mated relationship and urge the electrical circuit 30 to an active, closed status when the modules 12, 12a are in a separated relationship.

The alarm switch 36a in the module 12a has a reed switch 52a in magnetic communication with a switch magnet 54 in the opposite module 12. The paired, opposed switch magnet 54 and reed switch 52a urge the electrical circuit 30a to an inactive, open status when the modules 12, 12a are in a mated relationship and urge the electrical circuit 30a to an active, closed status when the modules 12, 12a are in a separated relationship.

Figure 3:
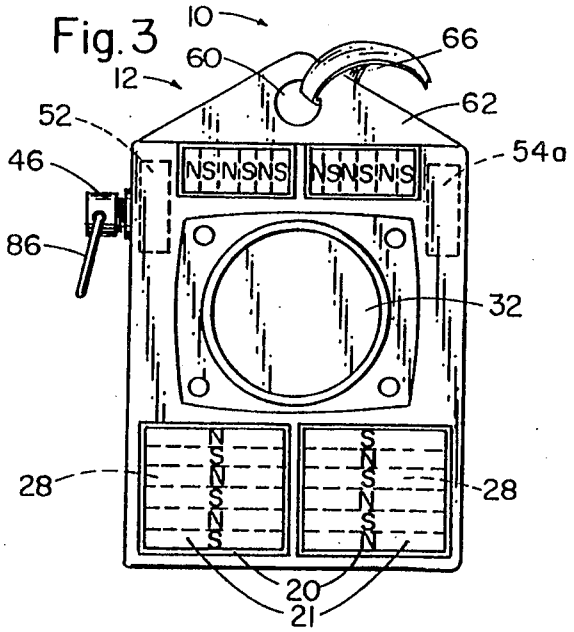
FIG. 3 is a elevation view of a module showing the exterior face and the siren transducer and the flat multipole coupling magnets.

As best seen in FIG. 3, the alarm system 10 is armed by coupling the paired modules 12, 12a in a congruent relationship. The lower section 18 of each module 12 has a plurality of the recesses 20,20a, with each recess 20 therein being adapted to receive one of the flat rectangular multipole magnets 28. Likewise, each module 12 has a plurality of the recesses 23,23a in the upper section 22 with each recess 23 therein being adapted to receive one of the flat rectangular multipole magnet 28 for urging horizontal congruence between the modules 12 and 12a. The multipole magnet 28 in each recess 20 of the lower section 18 urges vertical congruence between the modules 12 and 12a.

Each module 12 has an aperture 60 in a lug 62 on an upper side 64. The aperture 60 is adapted to receive the first end 66 of a lanyard 68. The lanyard 68 has a second end 70 adapted for coupling the module 12 to a person, or in an alternative embodiment to a fixture.

A leash 72 has a first end 74 attached to the aperture 60a in the lug 62a of the paired, opposed module 12a. The leash 72 has a second end 76 adapted for removable attachment to the valuable item, such as a pet, a purse, a briefcase or the like.

Figure 6B:
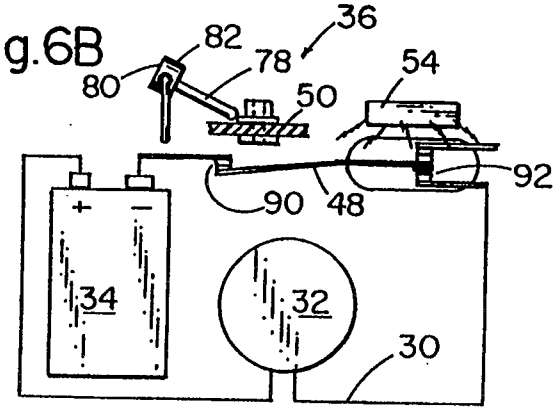
FIG. 6B is a schematic diagram of the electrical circuit showing the module in the armed condition by the removal of the switch pin from the jack switch.
Figure 6C:
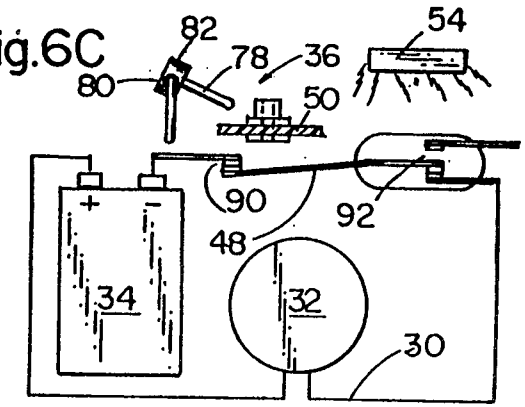
FIG. 6C is a schematic diagram of the electrical circuit in each module showing the module in the activated state when the switch pin has been removed and the switch magnet has been removed from magnetic proximity to the opposed reed switch.
Figure 6A:
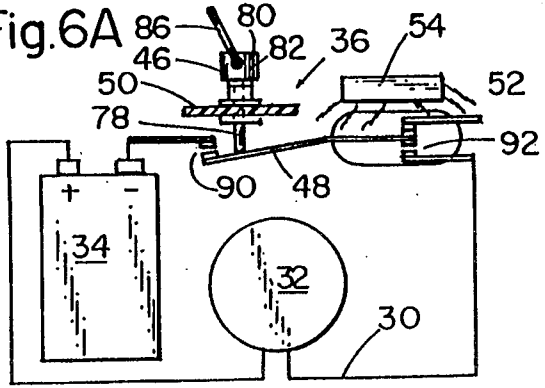
FIG. 6A is a schematic diagram of the electrical circuit in each module showing the module in the override condition with the pin switch engaging and opening the jack switch and the switch magnet in magnetic proximity with the reed switch in the opposed module thereby opening the reed switch.

The alarm system 10 is prepared for use and operation by first mating the paired, opposed modules 12 and 12a in a congruent relationship by coupling the interior faces 16, 16a thereof in magnetic communication. As best seen in FIG. 6A, each electrical circuit 30 is disarmed by the elongated switch pin 46 contacting and deflecting the flat bar element 48 of the jack switch 50. The alarm system 10 is put in the armed status by removing the elongated switch pin 46 from each recess 44 as best seen in FIG. 6B. It should be noted that each module 12, 12a has an individual elongated switch pin 46 and jack switch 50 configuration. Accordingly, one might choose to arm only the personal module 12 or only the item module 12a by removing the respective elongated switch pin 46, or one might choose to arm both modules 12 and 12a by removing the respective elongated switch pin 46 from the recess 44 in each module 12.

Each elongated switch pin 46 has a first end 78 adapted to contact the flat bar element 48 of the jack switch 50 for arming and disarming the electrical circuit 30 in each module 12. A second end 80 of each elongated switch pin 46 has a knob 82 adapted to receive a safety chain 84. Each safety chain 84 has a first end 86 attached to the knob 82 and a second end 88 adapted for attachment to the belt of the person.

As best seen in FIG. 6A, each electrical circuit 30 is in a disarmed state as long as the elongated switch pin 46 is engaged with the flat bar element 48 of the jack switch 50. Secondly, the mating of the paired, opposed modules 12 and 12a causes each switch magnet 54 behind the outer casing 14 to open each reed switch 52 in the opposite module 12, 12a. It can be seen by inspection that there are two openings in each electrical circuit 30 therein. A first opening 90 being the elongated switch pin 46 deflecting the flat bar element 48 of the jack switch 50 and a second opening 92 being the switch magnet 54 opening the reed switch 52.

As best seen in FIG. 6B, each electrical circuit 30 achieves an armed status when the elongated switch pin 46 is removed, thereby disengaging from the flat bar element 48 of the jack switch 50 and closing the first opening 90 in each electrical circuit 30. However, each electrical circuit 30 is still in an open status because the switch magnet 54a in the opposed module 12, 12a holds the reed switch 52 in the open position 92.

When the armed modules 12 and 12a are separated due to a thief pulling the valuable item from the person or dropping the briefcase or the like, the electrical circuit 30 in each module 12 is activated when the switch magnet 54a is removed from an effective range of about ½ inch from the reed switch 52 in the opposite module 12. At this point a audible noise of about 100 to 120 decibels, as measured within the arms-length of the person wearing the personal module 12 or approximately 30 centimeters from the item module 12a, is generated by each siren transducer 32 thereby alerting law enforcement personnel and passersby to a robbery or an attack taking place.

The electrical circuit 30*a* in the item module 12*a* will continue to generate an audible sound until the portable power source 34*a* is exhausted. The person wearing the personal module 12 can disconnect the electrical circuit 30 in the personal module 12 by merely reinserting the elongated switch pin 46 in the recess 44 to contact and deflect the flat bar element 48 of the jack switch 50 and disarm the electrical circuit 30. In this case, the reed switch 52 is in a closed position because of the separated relationship of the modules 12 and 12*a* after the robbery or the like. The power source 34 for each electrical circuit 30 is a direct current battery, preferably a replaceable type nine volt battery.

Each siren transducer 32 generates an audible alarm that can be modulated to produce an attention-getting variation in the output sound. Either amplitude modulation or frequency modulation can be utilized to produce a variation in the output sound.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention. Now that the invention has been described,

What is claimed is:

1. An alarm system for protecting a person and a valuable item from a thief comprising in combination:

a personal module and an item module, the modules being identical and each module having an exterior face with each exterior face having a plurality of recesses for respectively receiving a plurality of couplers, each coupler being made from a magnetic material and adapted to effect a mated, direct physical contact relationship between the modules, each module further having a casing constructed of a rigid non-magnetic material;

an electrical circuit within each casing having a transducer and a power source and an alarm switch means therebetween, the alarm switch means being adapted to close thereby connecting the transducer and the power source to activate the transducer upon separation of the modules, and further being adapted to disconnect the transducer and the power source and deactivate the transducer upon the mating of the modules;

a lanyard having a first end adapted for attachment to the personal module and a second end adapted for attachment to the person;

a leash having a first end adapted for attachment to the item module and a second end adapted for attachment to the valuable, item; and each module further having a normally closed jack switch for closing the circuit between the transducer and the power source when said switch is closed, whereby the system is placed in an armed state.

2. An alarm system as recited in claim 1 wherein the magnetic material for each coupler includes a plurality of flat multipole magnets enclosed in a flexible thermoplastic binder.

3. An alarm system as recited in claim 2 wherein each respective jack switch further includes a pin having a first end for insertion in an aperture in the respective module for opening the respective jack switch by deflecting a flat bar element, the open jack switch urging the electrical circuit to remain in an open circuit and disarmed state regardless of whether the modules are separated or mated.

4. An alarm system as recited in claim 3 wherein each pin has an elongated cylindrical shape and has a second end adapted for attachment to a chain.

5. An alarm system as recited in claim 2 wherein the alarm switch means in each module casing includes a reed switch for placement in a paired, opposed relationship with a switch magnet in a respectively coupled module casing, each switch magnet being recessed inside the module casing of its respective module and the opposed reed switch being recessed inside the casing of the respectively coupled module, each paired switch magnet and reed switch being in magnetic communication for effecting one of a deactivated and activated relationship in the respective electrical circuits of respectively paired modules when the paired modules are in one of a mated and separated relationship, respectively.

6. An alarm system as recited in claim 5 wherein each reed switch is resiliently biased to a normally closed position for connecting the respective transducer to the respective power source and activating the respective transducer when the respective module is in a separated relationship with respect to a further module, and magnetically biased by the respective opposed switch magnet to an open position for disconnecting the respective transducer and the respective power source and deactivating the respective transducer when the respective module and a further module are in a mated relationship.

7. An alarm system as recited in claim 2 wherein each magnetic coupler in one of said exterior faces further includes a plurality of magnetic poles respectively associated with the flat multipole magnets of the corresponding coupler on a surface thereof, oriented in an alternating north-south polarity sequence, each magnetic coupler in the other of said exterior faces also having a plurality of magnetic poles respectively associated with the flat multipole magnets of the corresponding coupler on a surface thereof and oriented in an alternating south-north polarity sequence, thereby urging magnetic mating between the personal module and the item module when the exterior faces are in the opposed relationship.

8. An alarm system as recited in claim 7 wherein the magnetic couplers in the respective exterior faces urge the respective modules to align themselves in a congruent horizontal and vertical relationship when the external faces are in a mated relationship.

9. An alarm system as recited in claim 1 wherein the power source in each module is a replaceable direct current battery.

10. An alarm system as recited in claim 1 wherein each transducer includes a siren for generating an audible alarm of at least 110 decibels at substantially arm's length distance from the person or item to which the respective module is attached.

11. An alarm system as recited in claim 10 wherein each siren includes a modulator to produce an attention getting variation in the output sound of the respective siren.

12. An alarm system as recited in claim 11 wherein each modulator produces the attention getting variation in the output sound of the respective siren by frequency modulation.

13. An alarm system as recited in claim 11 wherein each modulator produces the attention getting variation in the output sound of the respective siren by amplitude modulation.

14. An alarm system as recited in claim 1 wherein each module casing is made from a non-magnetic plastic material.

* * * * *